US007670173B2

(12) United States Patent
Hu et al.

(10) Patent No.: US 7,670,173 B2
(45) Date of Patent: Mar. 2, 2010

(54) MODULAR JACK WITH IMPROVED GROUNDING MEMBER

(75) Inventors: Jun-Hua Hu, Kunshan (CN); Qing Wan, Kunshan (CN); Li-Chun Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/157,547

(22) Filed: Jun. 10, 2008

(65) Prior Publication Data

US 2008/0248695 A1 Oct. 9, 2008

Related U.S. Application Data

(62) Division of application No. 11/708,859, filed on Feb. 20, 2007, now Pat. No. 7,384,310.

(51) Int. Cl.
*H01R 13/66* (2006.01)

(52) U.S. Cl. ..... 439/541.5; 439/607.23; 439/620.11

(58) Field of Classification Search ..... 439/541.5, 439/620.18, 620.11, 607, 607.23, 607.25, 439/607.26, 607.01, 939, 108, 79, 891, 843
See application file for complete search history.

(56) References Cited

U.S. PATENT DOCUMENTS 5,017,158 A * 5/1991 Liu et al. ..... 439/609
5,037,330 A * 8/1991 Fulponi et al. ..... 439/607
5,167,531 A * 12/1992 Broschard et al. ..... 439/541.5
6,234,834 B1 * 5/2001 Tsai et al. ..... 439/541.5
6,474,999 B1 * 11/2002 Givens et al. ..... 439/76.1
6,508,665 B1 * 1/2003 Yeh ..... 439/541.5
6,666,716 B2 12/2003 Chien-Chung
6,743,047 B2 6/2004 Korsunsky
6,835,092 B2 * 12/2004 Wan et al. ..... 439/541.5
7,090,535 B2 8/2006 Wan
D548,192 S * 8/2007 Wan et al. ..... D13/147
2003/0100218 A1 * 5/2003 Tsai et al. ..... 439/490
2004/0259414 A1 * 12/2004 Shih ..... 439/541.5
2005/0095908 A1 * 5/2005 Xue et al. ..... 439/541.5
2006/0014431 A1 * 1/2006 Shuey et al. ..... 439/607

* cited by examiner

*Primary Examiner*—Neil Abrams
*Assistant Examiner*—Harshad C Patel
(74) *Attorney, Agent, or Firm*—Ming Chieh Chang; Wei Te Chung; Andrew C. Cheng

(57) ABSTRACT

A modular jack (100) adapted for receiving a pair of mating connectors includes an insulative housing (1) having a pair of cavities (10) for receiving the corresponding mating connectors, a number of terminal modules (3) received in the cavities for electrically connecting with the mating connector, and a conductive outer shield (2) enclosing the corresponding insulative housing. The modular jack further has a detachable grounding member (7) made from conductive material and electrically connected with the conductive outer shield for grounding. The grounding member has a number of contacting plates (7121,7131,7141) extending into the corresponding cavities for connecting and grounding the corresponding mating connectors.

20 Claims, 8 Drawing Sheets

MODULAR JACK WITH IMPROVED GROUNDING MEMBER

CROSS-REFERENCE TO RELATED APPLICATIONS

This application is a divisional application of U.S. patent application Ser. No. 11/708,859, filed on Feb. 20, 2007 now U.S. Pat. No. 7,384,310, and entitled "ELECTRICAL CONNECTOR WITH RELIABLE STRUCTURE AND METHOD FOR MAKING THE SAME", which has the same applicant and assignee as the present invention.

BACKGROUND OF THE INVENTION

1. Field of the Invention

The present invention relates to a modular jack, and particularly to a modular jack having an improved grounding member.

2. Description of Prior Arts

U.S. Pat. No. 7,090,535 issued on Aug. 15, 2006 discloses a modular jack. The modular jack adapted for receiving a mating plug comprises an insulative housing defining a cavity for receiving a plug connector, a terminal module having a number of terminals, a daughter circuit board, a connecting modular and a conductive outer shield enclosing the insulative housing. Inner faces of the conductive outer shield has a pair of grounding members extending into the cavity for mating and grounding the plug.

However, when the modular jack is made as a stacked configuration and comprises a plurality of stacked cavities for receiving a plurality of plugs, the modular jack should be formed with a plurality of grounding members in corresponding cavities for grounding corresponding plugs. Therefore, manufacture of the modular jack is complicated and the cost of the manufacture increases.

Hence, it is desirable to provide an improved modular jack to overcome the aforementioned disadvantages.

SUMMARY OF THE INVENTION

An object of the present invention is to provide a modular jack having a grounding member adapted for engaging with a plurality of mating connectors.

To achieve the above object, a modular jack adapted for receiving a pair of mating connectors includes an insulative housing having a pair of cavities for receiving the corresponding mating connectors, a plurality of terminal modules received in the cavities for electrically connecting with the mating connector, a conductive outer shield enclosing the corresponding insulative housing. The modular jack further has a detachable grounding member made from conductive material and electrically connected with the conductive outer shield for grounding. The grounding member comprises a plurality of contacting plates extending into the corresponding cavities for connecting and grounding the corresponding mating connectors.

Advantages of the present invention are to provide a detachable grounding member having a plurality of contacting plates extending into both cavities for grounding both mating connectors. With this arrangement, it doesn't need to provide a plurality of grounding members in both cavities of the insulative housing for mating with both of connectors. Therefore, the manufacture of the modular jack has been simplified, and the cost of the manufacture has been saved.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
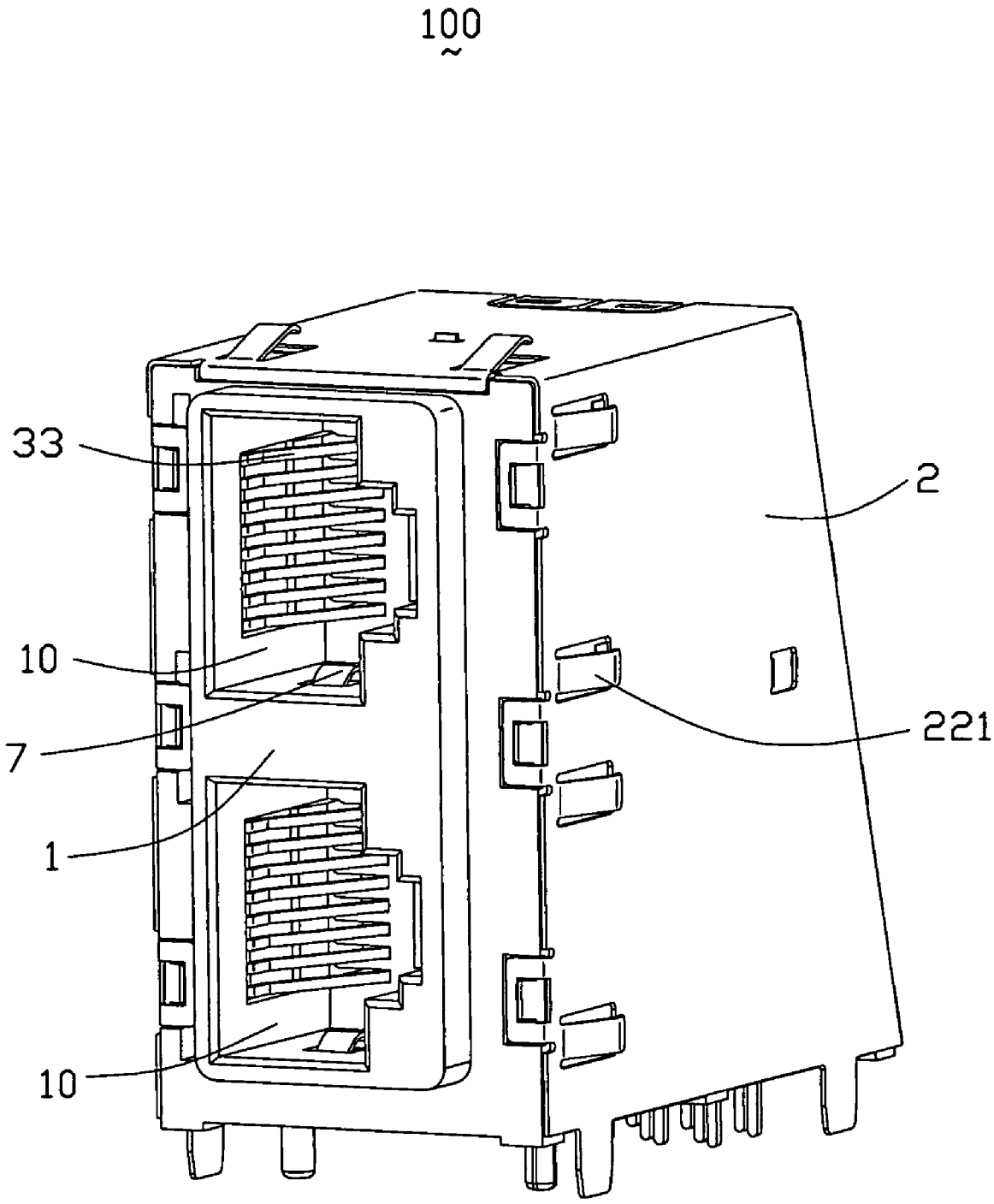
FIG. 1 is an assembled perspective view of a modular jack according to the present invention.
Figure 2:
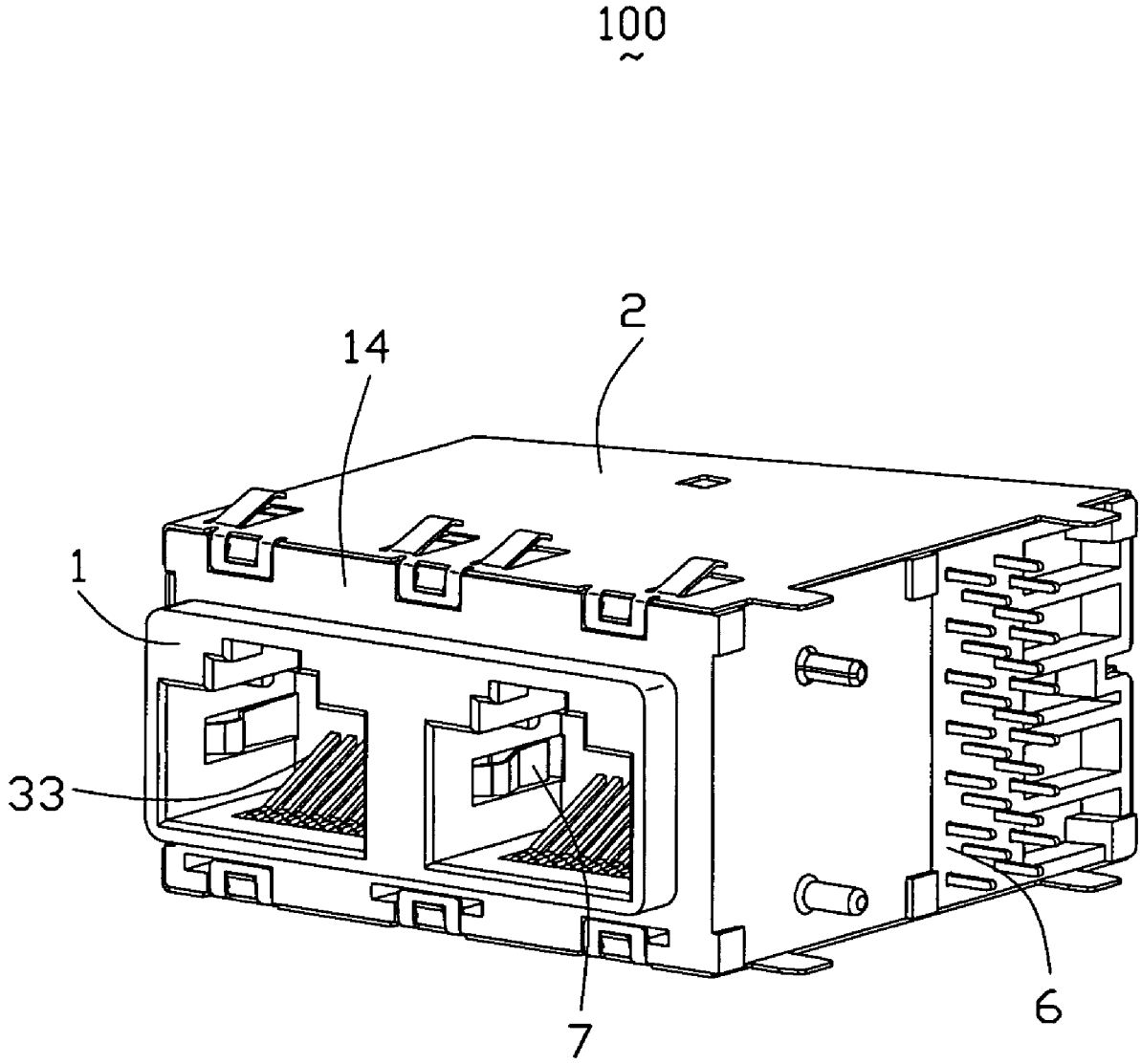
FIG. 2 is a perspective view similar to FIG. 1, taken from another aspect.

Reference will now be made to the drawing figures to describe the present invention in detail. Referring to FIGS. 1-5, a modular jack 100 adapted for receiving a pair of plugs (not shown) in accordance with the present invention comprises an insulative housing 1, a conductive outer shield 2 enclosing the insulative housing 1, a pair of terminal modules 3, a daughter circuit board 4, a pair of anti-mismating devices 5, a connecting module 6 and a grounding member 7. In another embodiment, the modular jack 100 may also be used for receiving other kinds of mating connectors.

The insulative housing 1 includes a top wall 11, a pair of side walls 12, a bottom wall 13, a front mating face 14 and a rear portion 15. The insulative housing 1 has a pair of plug-receiving cavities 10 extending rearwardly from the front mating face 14. The bottom wall 13 includes a mounting portion 131 extending horizontally rearwardly for engaging with the connecting module 6, and a pair of protrusions 133 downwardly projecting from a lower surface of the bottom wall 13. A plurality of embossments 141 are disposed on lateral edges of the front mating face 14 for locking with the conductive outer shield 2. The rear portion 15 defines an E-shaped receiving channel 151 and three passageways 152 extending in a longitudinal direction in communication with the plug-receiving cavities 10 for engaging with the grounding member 7. An array of first posts 153 are disposed on the rear portion 15 for engaging with the terminal modules 3. An array of second posts 154 are disposed adjacent to the first posts 153 for engaging with the anti-mismating devices 5. The top wall 11 defines a hole 110 in a middle thereof.

Figure 3:
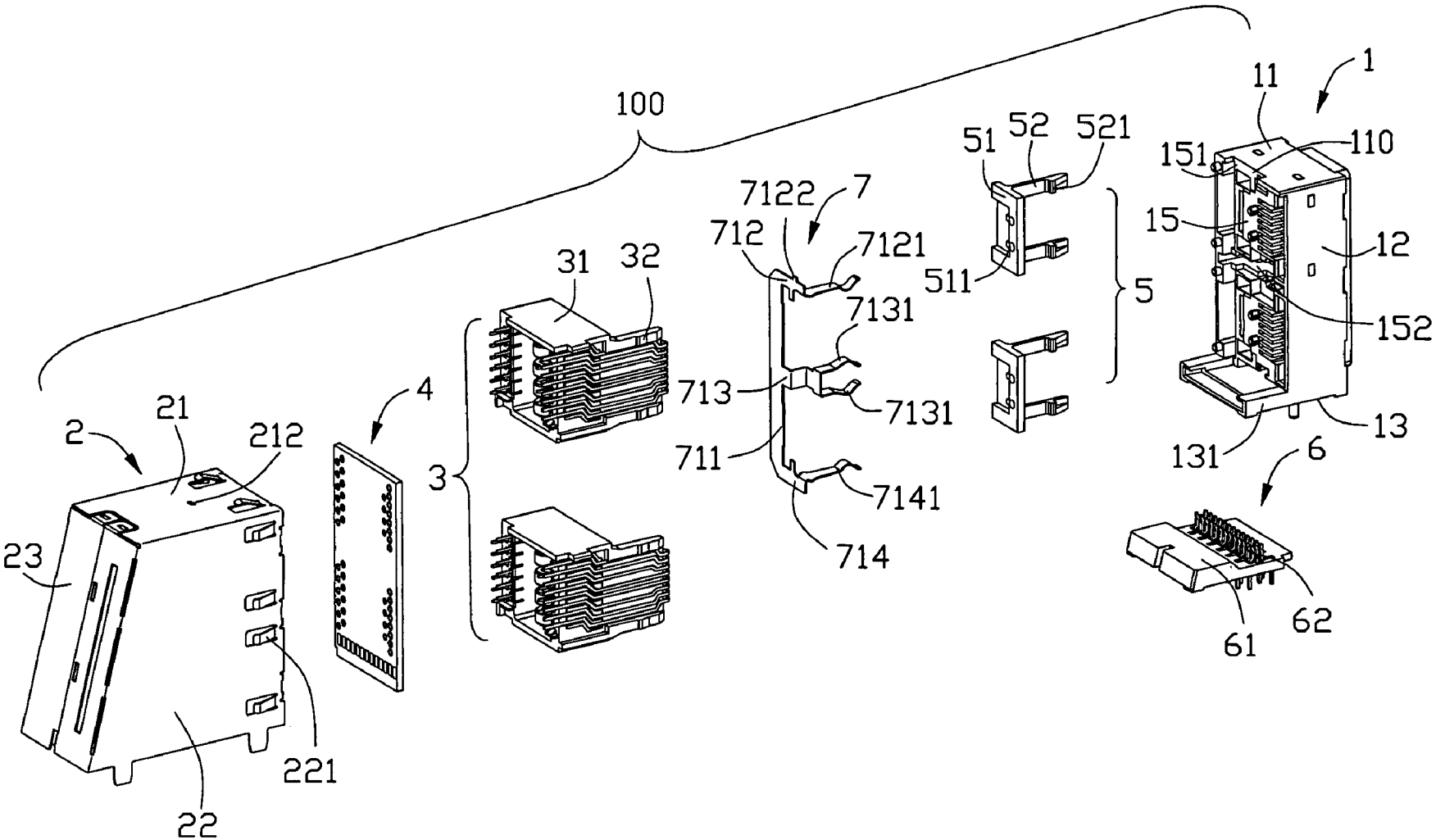
FIG. 3 is an exploded view of the modular jack as shown in FIG. 1.
Figure 4:
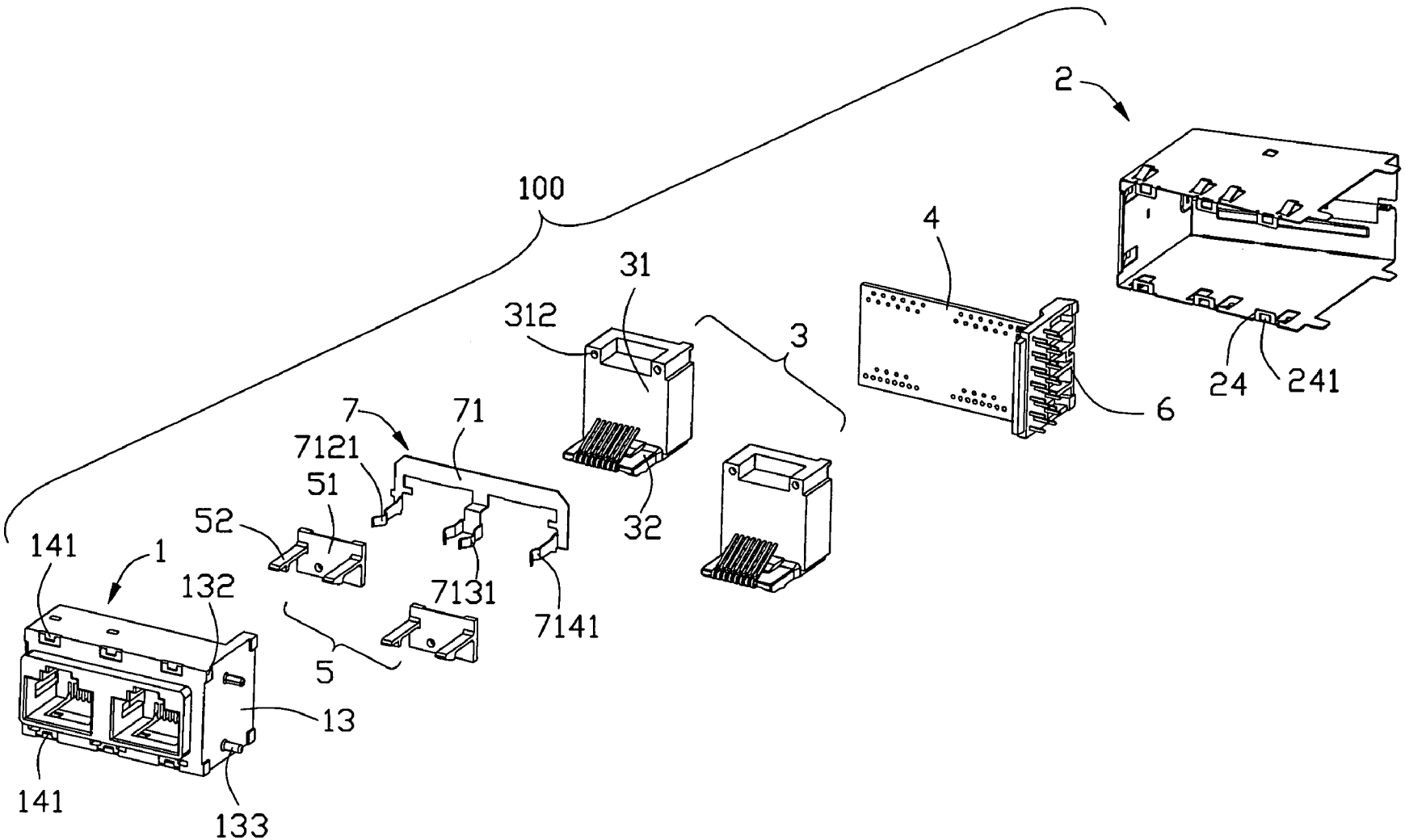
FIG. 4 is another exploded view similar to FIG. 3, taken from another aspect.

Referring to FIGS. 3 and 4, the conductive outer shield 2 is stamped from a metal sheet. The conductive outer shield 2 comprises a top face 21, a pair of side faces 22 bending downwardly from lateral portions of the top face 21, and a pair of rear faces 23 bending rearwardly from the side faces 22 for engaging with each other. The side face 22 is of a trapezoidal configuration, wherein an upper edge of the side face 22 is shorter than a lower edge of the side face 22. The side face 22 defines a plurality of recesses 241 for mating with embossments 141 of the insulative housing 1. An engaging hole 212 is defined on the top face 21.

Figure 6:
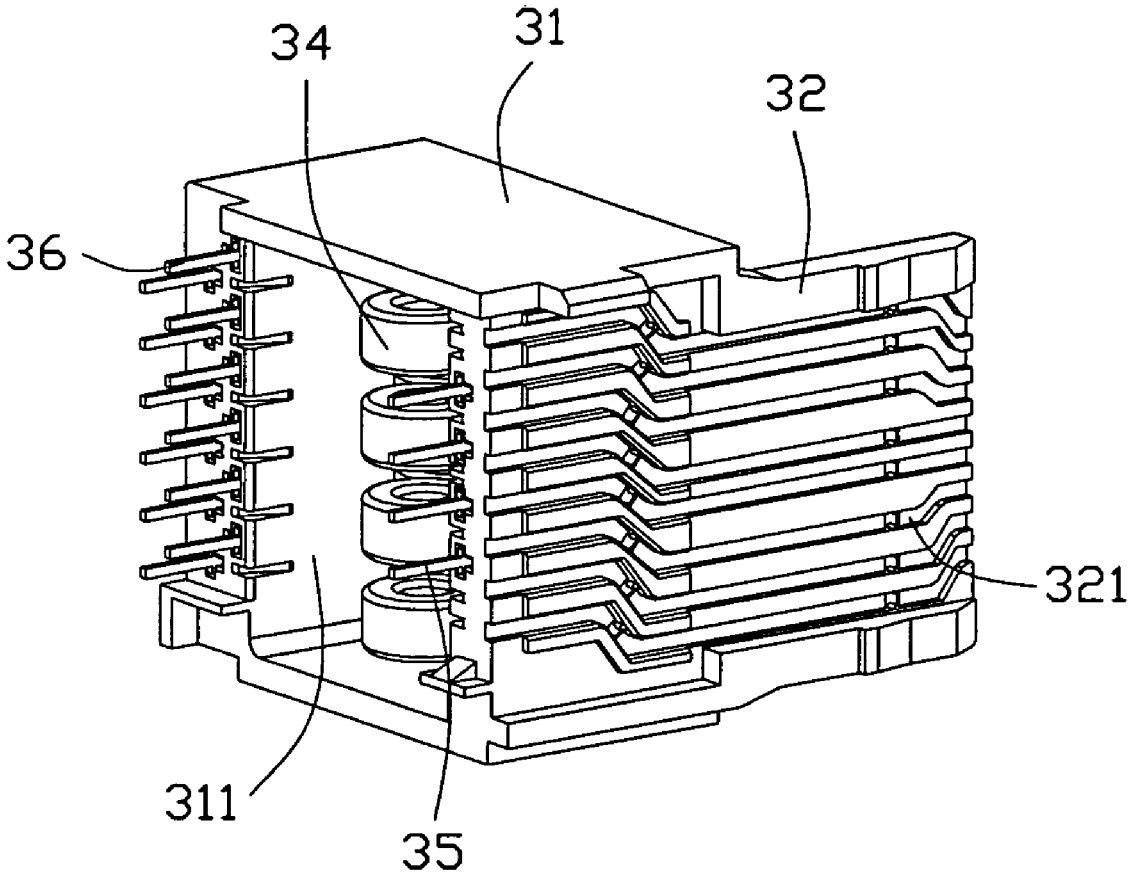
FIG. 6 is an assembled perspective view of a terminal module.

Referring to FIG. 6, the terminal module 3 includes a base portion 31, a tongue portion 32 extending forwardly from the base portion 31, a plurality of conductive terminals 321 received in the tongue portion 32, a plurality of magnetic coils 34 and a plurality of first and second transition terminals 35, 36. The conductive terminals 321 are electrically connected with the first and the second transition terminals 35, 36 via the magnetic coils 34.

Figure 7:
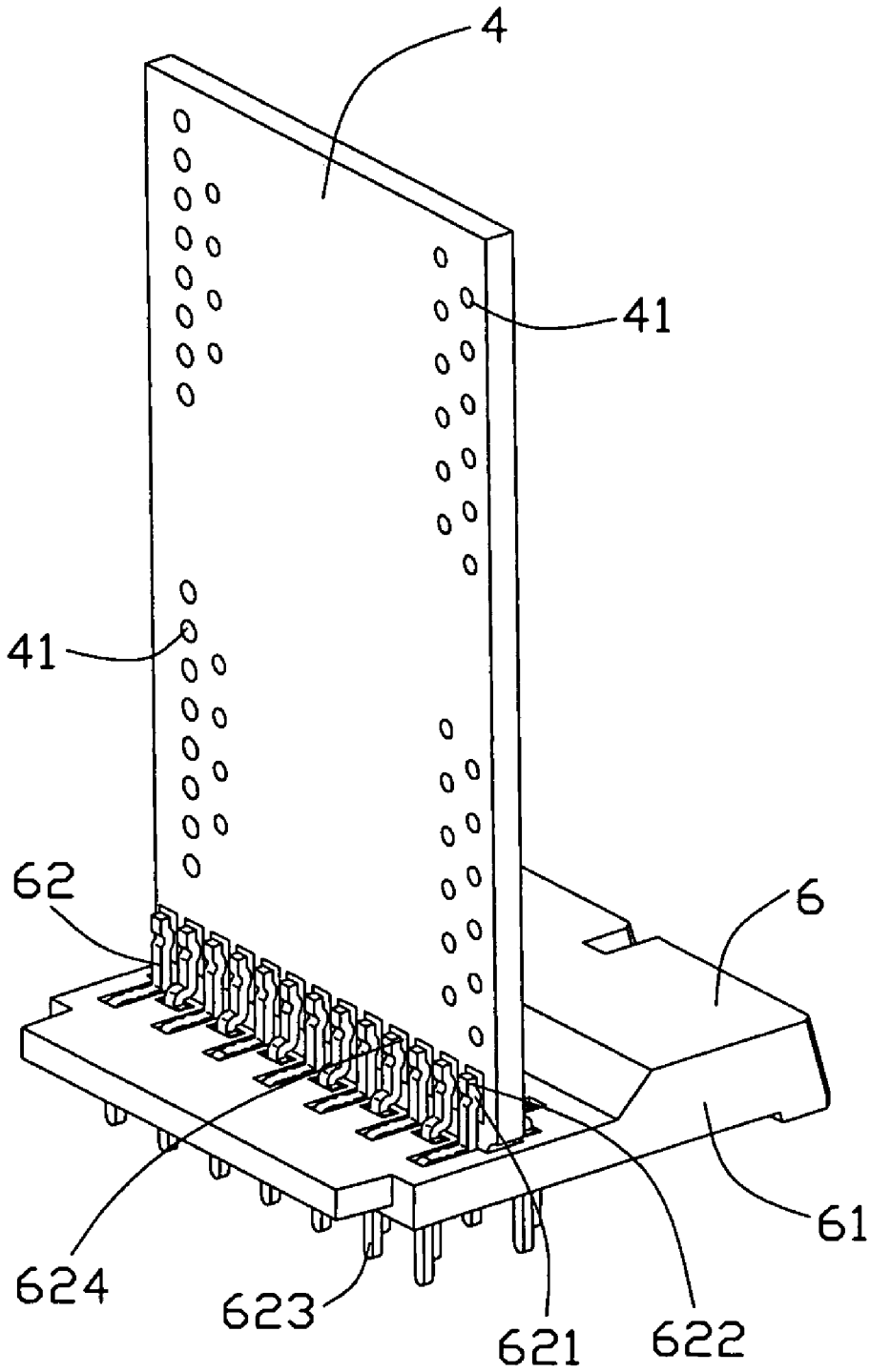
FIG. 7 is a partially assembled view showing a daughter circuit board mounted on a connecting module.
Figure 8:
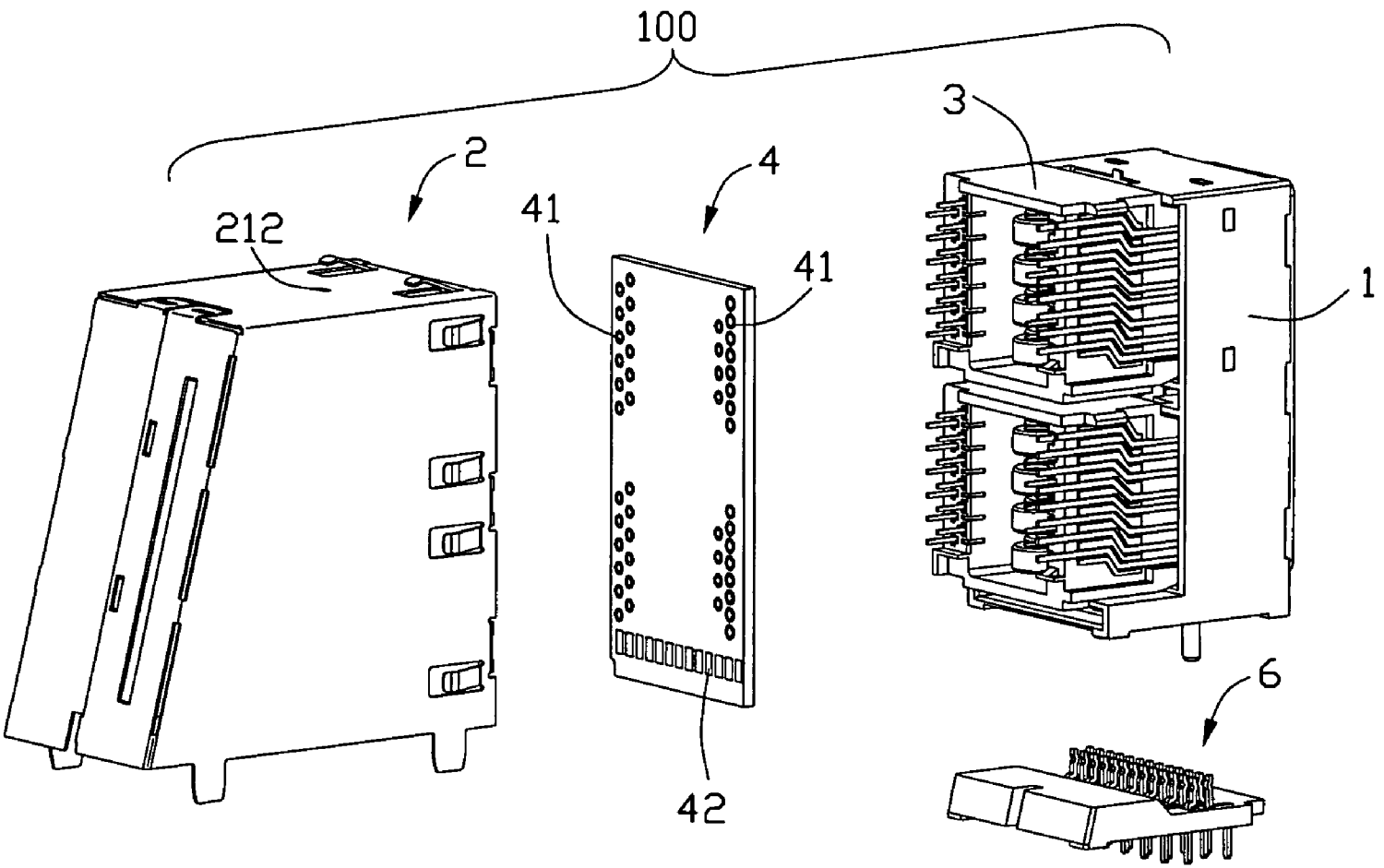
FIG. 8 is a partially assembled view of the modular jack showing a pair of terminal modules assembled to the insulative housing.

Referring to FIGS. 7 and 8, the daughter circuit board 4 has a plurality of vias 41 and conductive pads 42, and desired circuitry, as is well known in this art.

Referring to FIG. 7, the connecting module 6 has an insulative portion 61 and two arrays of connecting contacts 62 mounted on the insulative portion 61. Each connecting contact 62 has an arched connecting portion 621, a distal portion 622 extending upwardly from the connecting portion 621, and a soldering portion 623 extending downwardly from the arched connecting portion 621. In assembly of the daughter circuit board 4 and the connecting module 6, the daughter circuit board 4 is inserted between the two arrays of connecting contacts 62 to thereby form a receiving portion 624 between the distal portion 622 and the daughter circuit board 4. When the connecting contacts 62 are soldered onto the daughter circuit board 4, the receiving portion 624 is used to receive solder to thereby prevent solder from creeping into other portions of daughter circuit board 4. The connecting portion 621 is electrically connecting with the conductive pads 42.

Figure 5:
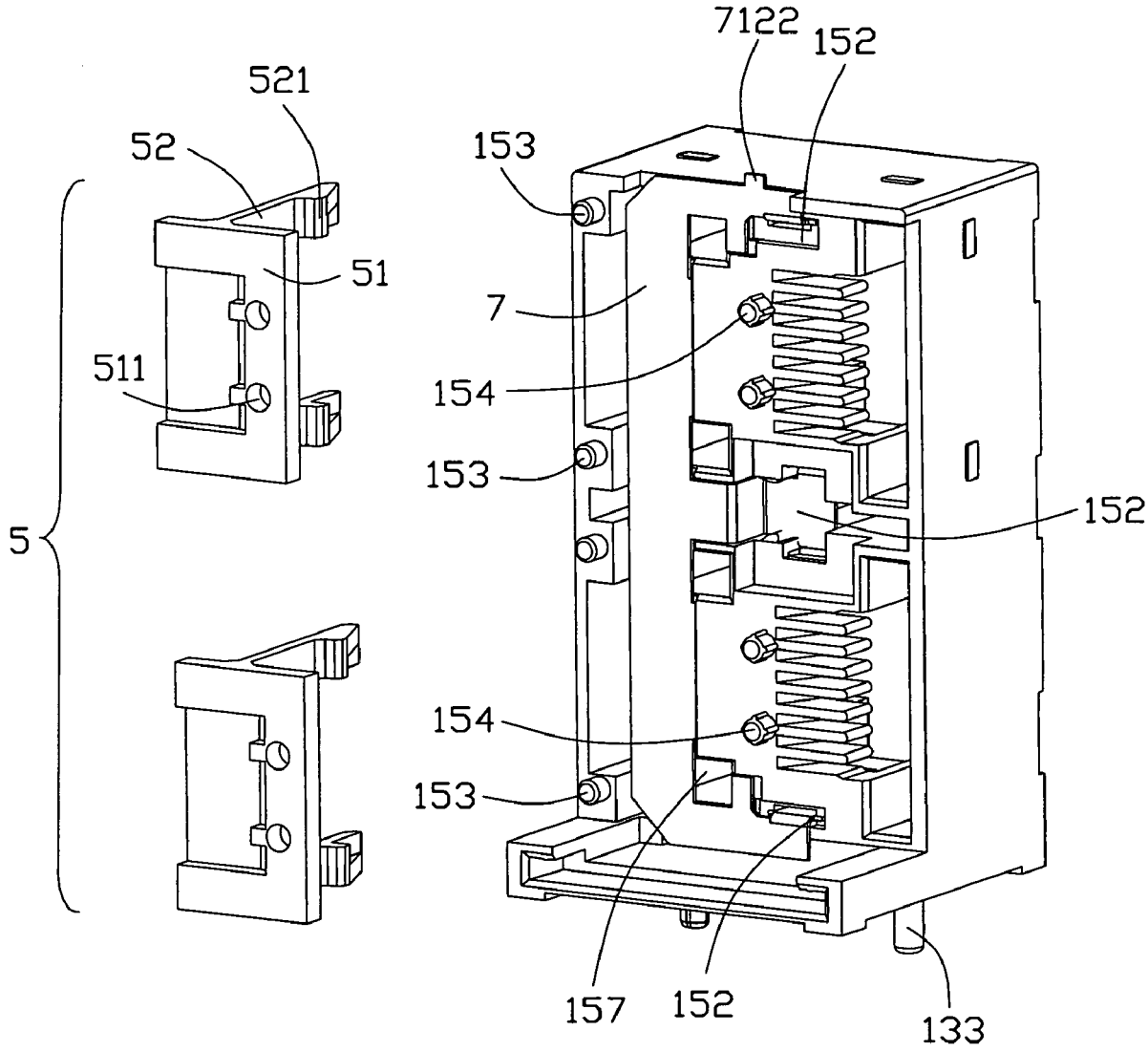
FIG. 5 is a partially assembled view of the modular jack, showing a grounding member secured within an insulative housing.

Referring to FIG. 5, each anti-mismating device 5 comprises a vertical main body 51 and a pair of cantilevers 52 extending forward from the main body 51. The main body 51 defines a pair of second fixing holes 511 for mating with the second posts 154. Each cantilever 52 includes a hook 521 projecting into the plug-receiving cavity 10 for preventing incorrect connectors from being inserted therein. In another embodiment, the module jack 100 does not include the anti-mismating device 5.

Referring to FIGS. 3 and 4, the grounding member 7 is substantially E-shaped and stamped from conductive material. The grounding member 7 includes a vertical body portion 711 and a first, a second and a third arms 712, 713, 714 respectively extending sidewardly from the body portion 711. The first arm 712 and the third arm 714 respectively have a first contacting plate 7121 and a third contacting plate 7141 perpendicularly extending therefrom. The first arm 712 further comprises a protrusion 7122 perpendicularly projecting therefrom for extending outside through the hole 110 of the top wall 11 for engaging with the engaging hole 212. The second arm 713 has a pair of contacting plates 7131 extending parallel to the first and the third contacting plates 7121,7141. All of the contacting plates 7121,7131,7141 are received in the plug-receiving cavities 10 for contacting and grounding the corresponding plug via the engagement between the protrusion 7122 and the shield top face 21. In another embodiment, when the insulative housing 1 has more than two stacked cavities 10 for receiving more than two plugs, the grounding member 7 has more than one pair of second contacting plates 7131 formed between the first and the third contacting plates 7121,7141 for grounding corresponding plugs.

In assembling, firstly, the grounding member 7 is assembled to the insulative housing 1. At this time, the vertical body portion 711 is received in the E-shaped receiving channel 151. The first, second and third arms 712, 713, 714 are respectively inserted into the three mating passageways 152 of the insulative housing 1 for grounding the corresponding plug. Secondly, the anti-mismating devices 5 are fixed into the rear portion 15 of insulative housing 1. The anti-mismating devices 5 abut against the vertical body portion 711 and the pair of second fixing holes 511 mate with the second posts 154. Thirdly, the pair of terminal modules 3 are retained in the insulative housing 1. The tongue portions 32 are received in the corresponding plug-receiving cavities 10. Subsequently, the daughter circuit board 4 and the connecting module 6 are fixed to the insulative housing 1. The vias 41 and the conductive pads 42 respectively electrically connecting with the conductive terminals 321 and the connecting contacts 62 of the connecting module 6. Finally, the conductive outer shield 2 encloses the insulative housing and the protrusion 7122 of the grounding member 7 projects outwardly from the engaging hole 212.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack adapted for receiving a pair of mating connectors, comprising:

an insulative housing having a pair of cavities for receiving corresponding mating connectors;

a pair of terminal modules received in the cavities for electrically connecting with the mating connectors;

a conductive outer shield enclosing the insulative housing; and a detachable grounding member, made from conductive material and electrically connected with the conductive outer shield for grounding, the grounding member comprising a plurality of contacting plates extending into corresponding cavities for connecting and grounding corresponding mating connectors.

2. The modular jack as claimed in claim 1, wherein said grounding member comprises a protrusion for connecting with the conductive outer shield.

3. The modular jack as claimed in claim 2, wherein said grounding member comprises a vertical body portion, a first arm, a second arm and a third arm respectively extending sidewardly from the body portion.

4. The modular jack as claimed in claim 3, wherein said plurality of contacting plates comprise a first and a third contacting plates respectively perpendicularly extending from the first and the third arms.

5. The modular jack as claimed in claim 4, wherein said protrusion is disposed on the first arm and mates with an engaging hole defined on a top surface of the outer conductive shield.

6. The modular jack as claimed in claim 4, wherein said second arm is disposed between the first and the third arms and comprises a pair of second contacting plates substantially parallel to the first and the third contacting plates.

7. The modular jack as claimed in claim 1, wherein said insulative housing has a receiving channel defined at a rear portion thereof for engaging with the grounding member and a plurality of passageways extending in a longitudinal direction in communication with the cavities for extension of the contacting plates of the grounding member.

8. The modular jack as claimed in claim 1, wherein said conductive outer shield has a top face, a pair of side faces bending downwardly from lateral edges of the top face, and a pair of rear faces bent rearwardly from the side faces for engaging with each other, wherein said side face is of a trapezoidal shape, with an upper edge thereof being shorter than a lower edge thereof.

9. The modular jack as claimed in claim 1, further comprising a pair of anti-mismating devices received in the insulative housing for preventing incorrect insertion of mating connectors.

10. The modular jack as claimed in claim 1, wherein said terminal module comprises a base portion, a plurality of magnetic coils assembled to the base portion, a plurality of first and second transition terminals, and a plurality of conductive terminals, said first transition terminals being electrically connected with the second transition terminals via the magnetic coils.

11. The modular jack as claimed in claim 10, further comprising a daughter circuit board and a connecting module, the daughter circuit board having a plurality of vias and conductive pads, the connecting module having a plurality of connecting contacts, wherein the vias and the conductive pads are respectively electrically connecting with the conductive terminals and the plurality of connecting contacts of the connecting module.

12. The modular jack as claimed in claim 11, wherein each connecting contact comprises an arched connecting portion projecting inwardly, a distal portion extending upwardly from the connecting portion to thereby form a receiving portion between the distal portion and the daughter circuit board, and a soldering portion extending downwardly from the arched portion.

13. An electrical connector comprising:

an insulative housing defining stacked upper and lower mating ports in a vertical direction;

a plurality of contacts disposed in each of said upper and lower mating ports and arranged in essentially a juxtaposed manner with one another in the vertical direction;

a printed circuit board vertically positioned behind the housing and defining a plane perpendicular to a front-to-back direction of each of said upper and lower mating pods;

a plurality of connecting terminals connected to a bottom portion of the printed circuit board opposite to the housing; and a metallic shell covering the housing and the printed circuit board and the connecting terminals; wherein said shell defines a back plate extending obliquely to shield the printed circuit board which is located in front of the shell, and the connecting terminals which is located under the shell.

14. The electrical connector as claimed in claim 13, wherein said contacts are pre-assembled to a contact module which is inserted into the housing around the corresponding mating port.

15. The electrical connector as claimed in claim 13, wherein said connecting terminals are associated with a connecting module which is essentially located below the printed circuit board.

16. The electrical connector as claimed in claim 13, wherein the contacts in the upper mating port and those in the lower mating ports are disposed on a same lateral side of the housing which is opposite to the other later side on which a polarization keyway of each of said upper and lower mating ports is located.

17. An electrical connector comprising:

an insulative housing defining stacked upper and lower mating ports in a vertical direction;

a plurality of contacts disposed in each of said upper and lower mating pods;

a printed circuit board disposed at a rear portion of the insulative housing, said contacts electrically connected with the printed circuit board; and a metallic shell covering the housing and the printed circuit board and the contacts; wherein said shell includes a planar top face, a pair of side faces downwardly extending from two opposite lateral side edges of the top face, a bottom edge of each of said side faces being larger than an upper edge of the corresponding said side face, and a slated upward rear face; wherein said shell is essentially of a unitary piece, and said rear face includes two halves each extending unitarily from rear edges of the corresponding side faces, respectively.

18. The electrical connector as claimed in claim 17, wherein each of said side faces is trapezoidal, and said halves share a same seam essentially located in a center line of the housing.

19. The electrical connector as claimed in claim 17, wherein each of said side faces is trapezoidal, and said side faces unitarily extend from the two opposite lateral sides of the top face, respectively.

20. The electrical connector as claimed in claim 17, wherein the bottom edge of the side face is parallel to the upper edge, and said rear edge of the side face extends obliquely to allow the rear face to extend obliquely to form a lower space inside the metallic shell having a dimension larger than that of an upper space inside the metallic shell.

* * * * *